US011377800B2

(12) United States Patent
Fraser et al.

(10) Patent No.: US 11,377,800 B2
(45) **Date of Patent: *Jul. 5, 2022**

(54) APPARATUS FOR LAYING A PAVER

(71) Applicant: Redwood Plastics and Rubber Corp., Langley (CA)

(72) Inventors: Gregory A. Fraser, Langley (CA); Graeme K. Fraser, Langley (CA); Christian Guckel, Langley (CA)

(73) Assignee: Redwood Plastics and Rubber Corp., Langley (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/014,491

(22) Filed: Sep. 8, 2020

(65) Prior Publication Data

US 2020/0399838 A1 Dec. 24, 2020

Related U.S. Application Data

(63) Continuation of application No. 16/096,820, filed as application No. PCT/CA2017/050512 on Apr. 26, 2017, now Pat. No. 10,767,319.

(60) Provisional application No. 62/327,893, filed on Apr. 26, 2016.

(51) Int. Cl.
*E01C 5/00* (2006.01)

(52) U.S. Cl.
CPC ..... *E01C 5/001* (2013.01); *E01C 5/00* (2013.01)

(58) Field of Classification Search
CPC ... E01C 5/001; E01C 5/18; E01C 5/20; E01C 5/223; E01C 2201/02; E01C 2201/202; E01C 2201/207
See application file for complete search history.

(56) References Cited

U.S. PATENT DOCUMENTS

| | | | | |
|---|---|---|---|---|
| 2,792,164 | A | 8/1951 | Cauffiel | |
| 3,199,422 | A | 8/1965 | Rees, Jr. | |
| 5,006,011 | A * | 4/1991 | Hiyashi | E01C 5/223 404/37 |
| 5,118,547 | A * | 6/1992 | Chen | E01C 5/20 404/41 |
| 5,816,738 | A | 10/1998 | Harnapp | |
| 6,171,015 | B1 * | 1/2001 | Barth | E01C 5/001 404/34 |

(Continued)

FOREIGN PATENT DOCUMENTS

| | | |
|---|---|---|
| CA | 1205314 | 6/1986 |
| CA | 2904083 A1 | 10/2014 |

(Continued)

OTHER PUBLICATIONS

Terring Life Cycle BCE Place 161 Toronto, www.wegumanufacturing.com.

(Continued)

*Primary Examiner* — Abigail A Risic
(74) *Attorney, Agent, or Firm* — Chernoff, Vilhauer, McClung & Stenzel, LLP

(57) ABSTRACT

An apparatus for laying a paver has a body portion having a top side and an underside. A raised paver guide is located on the top side and is positioned to receive the paver when the paver is against the top side. The underside is at least partially hollow.

16 Claims, 7 Drawing Sheets

(56) References Cited

U.S. PATENT DOCUMENTS

| | | | | |
|---|---|---|---|---|
| 6,851,236 | B1 * | 2/2005 | Harvey | B26D 3/008 404/18 |
| 7,114,298 | B2 * | 10/2006 | Kotler | E01C 5/20 52/177 |
| 7,300,224 | B2 * | 11/2007 | Slater | E01C 9/086 404/36 |
| 7,344,334 | B2 * | 3/2008 | Thorkelson | E01C 5/18 404/28 |
| 7,527,451 | B2 | 5/2009 | Slater et al. | |
| 7,874,761 | B2 | 1/2011 | Prokhorenkov et al. | |
| D646,798 | S | 10/2011 | MacKenny | |
| 8,128,312 | B2 * | 3/2012 | Stuchell | E01C 5/223 404/43 |
| 8,282,310 | B2 | 10/2012 | White | |
| 8,336,278 | B2 * | 12/2012 | Smith | E04F 15/10 52/747.12 |
| 8,662,787 | B2 | 3/2014 | Sawyer et al. | |
| 8,696,234 | B2 * | 4/2014 | Smith | E01C 11/00 404/29 |
| 9,080,292 | B2 * | 7/2015 | Martinez | A47G 29/1216 |
| 9,303,365 | B2 | 4/2016 | Gooden | |
| 10,094,073 | B2 * | 10/2018 | Barth | E01C 5/001 |
| 2002/0141821 | A1 * | 10/2002 | Guidon | E01C 5/223 404/35 |
| 2003/0136070 | A1 * | 7/2003 | Ku | E04F 15/041 52/403.1 |
| 2003/0177728 | A1 * | 9/2003 | Ku | E04F 15/105 52/403.1 |
| 2005/0193663 | A1 * | 9/2005 | Lombardo | E01C 5/22 52/279 |
| 2010/0109189 | A1 * | 5/2010 | Brouwers | E01C 5/20 264/239 |
| 2010/0205899 | A1 * | 8/2010 | Califano | E01C 5/20 52/747.12 |
| 2010/0223880 | A1 * | 9/2010 | Smith | E01C 5/223 52/778 |
| 2010/0260545 | A1 | 10/2010 | Van Camp | |
| 2011/0052318 | A1 * | 3/2011 | Smith | E01C 5/00 404/73 |
| 2012/0034030 | A1 * | 2/2012 | Smith | E01C 5/001 404/34 |
| 2013/0167458 | A1 * | 7/2013 | Cerny | E04F 15/02194 52/177 |
| 2014/0161525 | A1 * | 6/2014 | Smith | E01C 5/18 404/41 |
| 2014/0186111 | A1 * | 7/2014 | Pawlaczyk | E01C 5/001 404/27 |
| 2014/0270944 | A1 * | 9/2014 | White | E01C 5/001 404/27 |
| 2014/0270945 | A1 * | 9/2014 | Bach | E01C 5/005 404/36 |
| 2014/0325924 | A1 * | 11/2014 | Schuster | E04F 15/02194 52/177 |
| 2014/0366461 | A1 * | 12/2014 | Busby | E04F 15/02044 52/126.6 |
| 2017/0328015 | A1 * | 11/2017 | Barth | E01C 9/004 |
| 2018/0038055 | A1 * | 2/2018 | Szekely | E01C 5/006 |

FOREIGN PATENT DOCUMENTS

| | | | |
|---|---|---|---|
| CN | 204238089 | U | 4/2015 |
| DE | 202014106285 | U1 | 7/2015 |
| FR | 2691485 | A1 | 11/1993 |
| FR | 2699944 | A1 | 7/1994 |
| JP | 2003166245 | A | 6/2003 |
| WO | 0233178 | A1 | 4/2002 |

OTHER PUBLICATIONS

International Search Report prepared by the Canadian Intellectual Property Office for PCT/CA2017/050512, dated Aug. 2, 2017, 4 pages.

Written Opinion prepared by the Canadian Intellectual Property Office for PCT/CA2017/050512, dated Aug. 2, 2017, 4 pages.

Photographs of usage of a device to keep pavers in place filed in the Canadian Federal Court for CA3,015,414, received Jan. 9, 2020, 9 pages.

Bill of Sale in Chinese for paver locking system filed in the Canadian Federal Court for CA3,015,414, received Jan. 9, 2020, 1 page.

Statement of Defence and Counterclaim filed in the Canadian Federal Court for CA3,015,414, filed Jun. 6, 2019, 8 pages.

* cited by examiner

APPARATUS FOR LAYING A PAVER

CROSS REFERENCE TO RELATED APPLICATIONS

This application is a continuation of U.S. patent application Ser. No. 16/096,820, filed Oct. 26, 2018, which is a national stage application filed under 35 USC 371 based on International Application No. PCT/CA2017/050512 filed Apr. 26, 2017 and claims priority under 35 USC 119 of U.S. Provisional Application No. 62/327,893, filed Apr. 26, 2016.

TECHNICAL FIELD

The present disclosure is directed at an apparatus for laying a paver.

BACKGROUND OF THE INVENTION

Pavers are blocks, such as paving stones, flagstones, tiles, and bricks, that can be dry laid to manufacture a surface. That surface may, for example, be the surface of a patio, roof deck, or balcony. Various techniques exist for aligning and laying pavers so that the resulting manufactured surface comprises consistently spaced pavers and can be manufactured with relative ease.

BRIEF SUMMARY OF THE INVENTION

According to a first aspect, there is provided an apparatus for laying a paver. The apparatus comprises a body portion having a top side and an underside, the underside comprising a hollow portion; and a raised paver guide located on the top side, the raised paver guide positioned to receive the paver when the paver is against the top side.

The hollow portion may comprise a paver guide receiver shaped to receive the raised paver guide such that a first instance of the apparatus is stackable on a second instance of the apparatus by inserting the raised paver guide of the second instance of the apparatus into the paver guide receiver of the first instance of the apparatus.

The body portion may be shaped as a closed curve, such as a circle, disc, or oval.

The body portion may be shaped as a polygon, and the paver guide receiver may comprise a channel that extends from one side of the polygon to another side of the polygon.

The polygon may be a square or rectangle, and the channel may extend from one side of the square or rectangle to an opposing side of the square or rectangle.

The raised paver guide and the paver guide receiver may be cruciform and centered on the top side and underside of the body portion, respectively.

The paver guide may taper from a maximum height at a center of the body portion to a minimum height at a periphery of the body portion.

The paver guide may comprise continuous lines. Alternatively, the paver guide may comprise discrete line segments. At least some of the line segments may be aligned with each other.

The underside may comprise support columns, each of which may comprise a hollow interior and may extend from the top side to the underside. The hollow portion may comprise the hollow interior of each of the support columns.

Each of the support columns may have a hexagonal footprint. Each of the support columns may alternatively have a circular footprint.

The body portion and raised paver guide may be manufactured using an elastomeric polymer.

According to another aspect, there is provided an apparatus for laying a paver. The apparatus comprises a square body portion having a top side and an underside; a raised, cruciform paver guide located on the top side, the raised paver guide centered on the top side and positioned to receive the paver when the paver is against the top side, and the underside comprises a paver guide receiver centered on the underside and shaped to receive the raised paver guide. The paver guide receiver comprises a first channel extending between one pair of opposing sides of the body portion and a second channel extending between another pair of opposing sides of the body portion, and the first and second channels intersect at a center of the underside. The underside also comprises hexagonal support columns, each of which has a hollow interior and extends from the top side to the underside.

According to another aspect, there is provided a surface, comprising multiple apparatuses for laying a paver, wherein each of the apparatuses is laid on a substrate and comprises a body portion having a top side and an underside, the underside comprising a hollow portion; and a raised paver guide located on the top side, the raised paver guide positioned to receive the paver when the paver is against the top side. The surface also comprises pavers laid on the top side of each the apparatuses, and each of the pavers is received by at least one of the raised paver guides.

This summary does not necessarily describe the entire scope of all aspects. Other aspects, features and advantages will be apparent to those of ordinary skill in the art upon review of the following description of specific embodiments.

BRIEF DESCRIPTION OF THE SEVERAL VIEWS OF THE DRAWINGS

In the accompanying drawings, which illustrate one or more example embodiments.

DETAILED DESCRIPTION OF THE INVENTION

Figure 1:
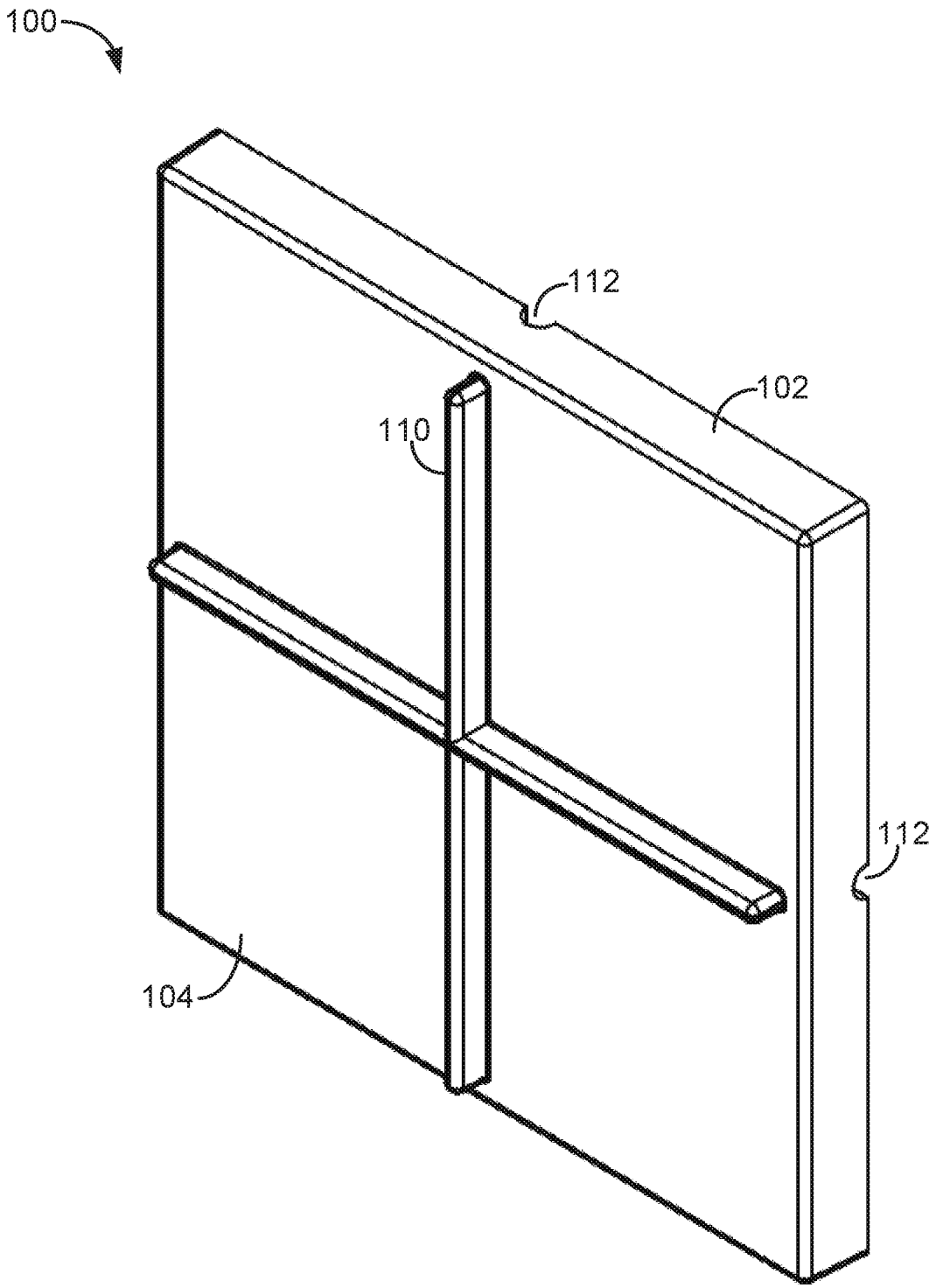
FIG. 1 is a top perspective view of an apparatus for laying a paver, according to one example embodiment.

Pavers may be used to manufacture a variety of different types of surfaces. In one example in which the surface is laid directly on soil, the soil is excavated, compacted, and levelled prior to the pavers being set on it. The pavers are then set and sand is used to fill the spaces between the pavers. The sand and pavers are tamped, excess sand is swept away, and the resulting surface is ready for use.

FIGS. 1 to 6 show an example apparatus for laying a paver P. In the depicted embodiment, the apparatus comprises a pad 100 of elastomeric material, such as a rubber polymer that may be recycled, that is cast from a mold. The pad 100 comprises a main body portion 102 having a top side 104 and an underside 106. The underside 106 of the pad 100 rests on a substrate S when the pad 100 is used to lay pavers P, while the pavers P are laid against the top side 104 of the pad 100.

A raised paver guide 110 is located on the pad's 100 top side 104. In the depicted embodiment, the paver guide 110 is cruciform and is centered on the center of the pad 100. The pad's 100 underside 106 includes a hollow portion in the form of a paver guide receiver; the paver guide receiver in the depicted embodiments is a pair of cruciform channels 112 that are also centered on the center of the pad 100. The channels 112 and paver guide 110 are shaped and positioned such that a first instance of the pad 100 is stackable on a second instance of the pad 100 by inserting the paver guide 110 of the second instance of the pad 100 into the channels 112 of the first instance of the pad 100. Stacking the pads 100 in this way facilitates space efficient transport of the pads 100.

The paver guide 110 in the depicted embodiment of the pad 100 comprises two continuous and linear raised portions that intersect at the center of the body portion 102 of the pad 100, thereby creating a cruciform paver guide 110. The channels 112 on the underside 106 of the pad 100 are accordingly similarly cruciform.

The underside 106 of the pad 100 also comprises multiple support columns 114, each of which has a hollow interior. The hollow portion on the underside 106 of the pad 100 comprises the hollow interior of each of the support columns 114. In the depicted embodiment of the pad 100, each of the support columns 114 that is not bounded by one or both of the channels 112 and the periphery of the pad 100 has a hexagonal footprint and the columns 114 accordingly collectively give the underside 106 a honeycomb shaped appearance. In different embodiments (not depicted), one or more of the support columns 114 may have differently shaped footprints; for example, in one different embodiment one or more of the support columns 114 may have a circular footprint, while in another different embodiment the support columns 114 may have non-hexagonal polygonal footprints. In certain other embodiments (not depicted), the support columns 114 may comprise two or more different footprints. In certain other embodiments (not depicted), the underside 106 of the pad 100 may not comprise any repeating pattern. In certain other embodiments (not depicted), the support columns 114 may have a filled or solid interior, and the space between the support columns 114 may be hollow and accordingly comprise the underside's 106 hollow portion.

Figure 3:
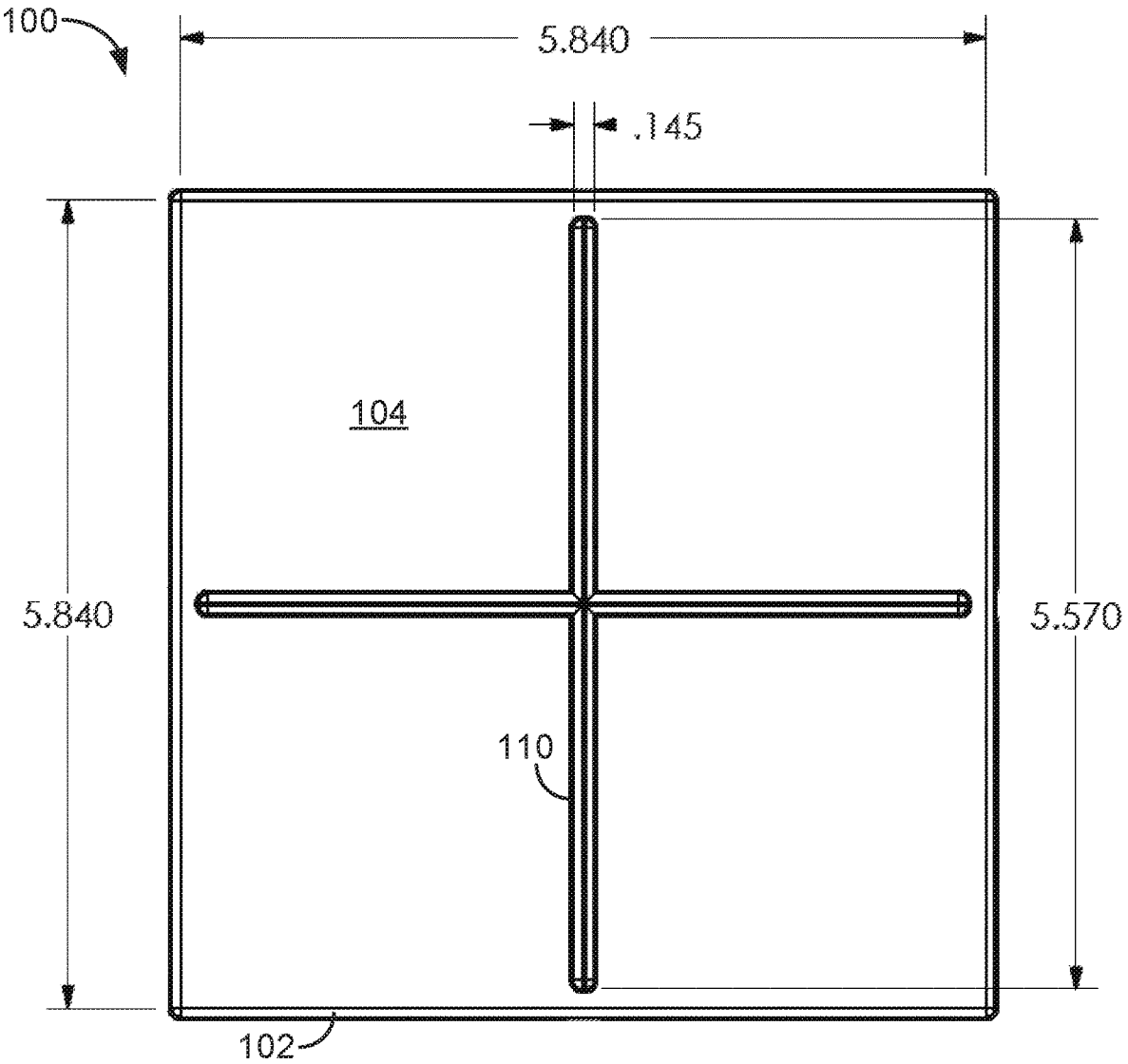
FIG. 3 is a top plan view of the apparatus of FIG. 1.
Figure 4:
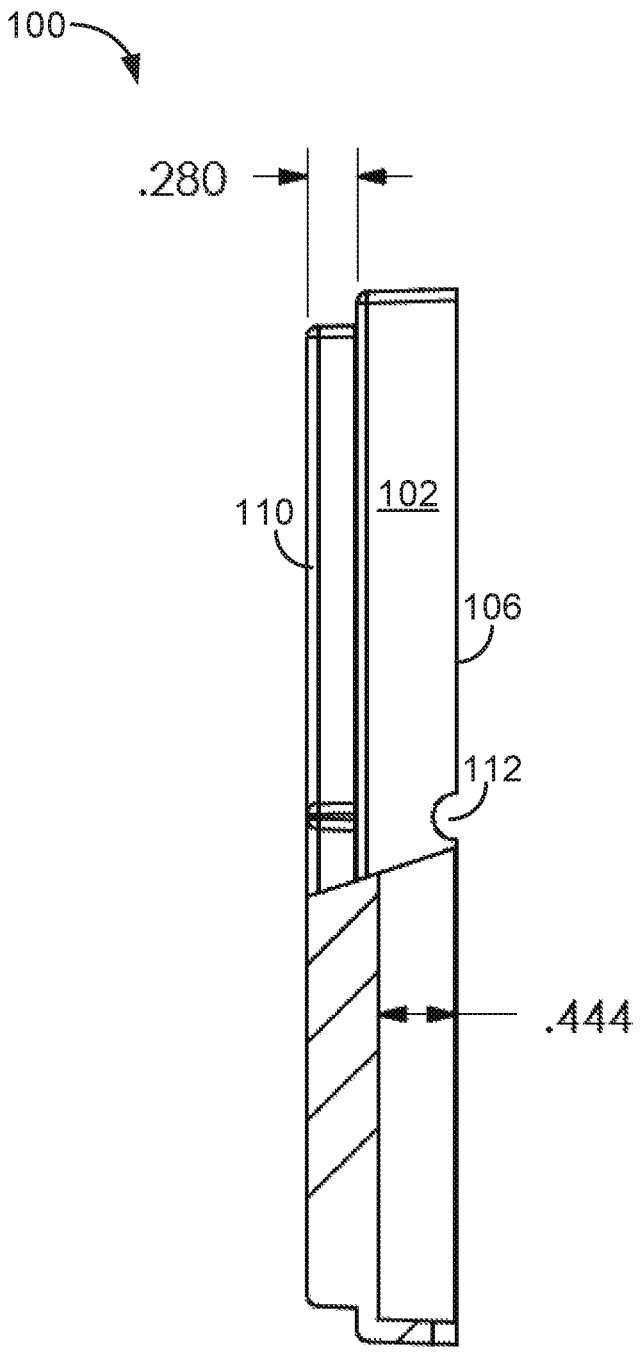
FIG. 4 is a partial cutaway, right side elevation view of the apparatus of FIG. 1.
Figure 5:
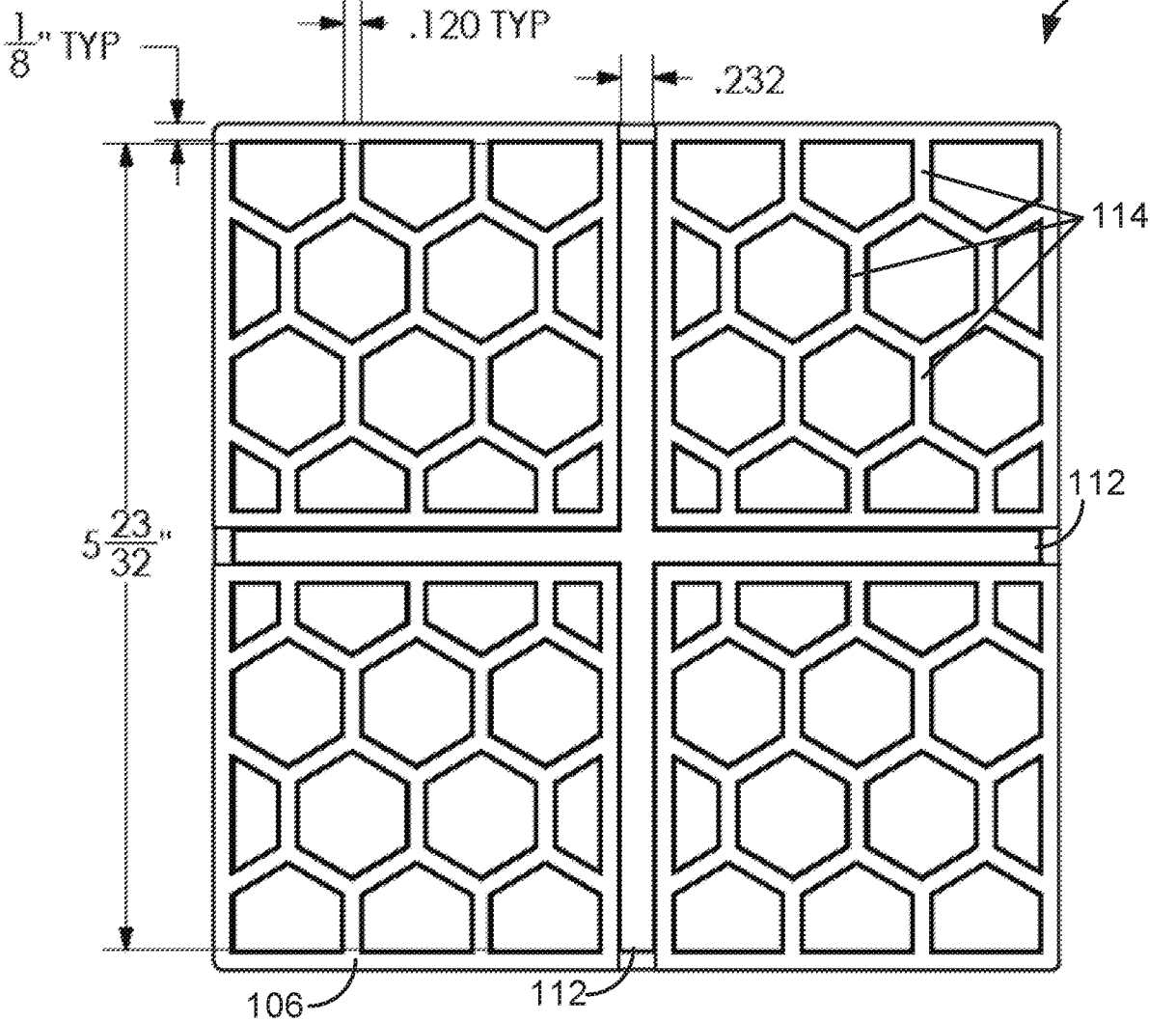
FIG. 5 is a bottom plan view of the apparatus of FIG. 1.

FIGS. 3 to 5 show the dimensions of an example pad 100 in inches. As shown in these figures, the depicted pad 100 has a square body portion 102 with sides of 5.840 inches and a height of 0.5 inches. The length of the paver guide 110 from one of the sides of the pad 100 to an opposing side of the pad 100 is 5.570 inches. The width of the paver guide 110 at its base is 0.145 inches while the height of the paver guide 110 is 0.280 inches. Each of the support columns 114 has a height of 0.444 inches. The thickness of the outer wall of the pad 100, which also acts as a wall for some of the support columns 114, is an eighth of an inch, while the thicknesses of the other walls of the support columns 114 is 0.120 inches. The length between the interior of opposing sides of the underside 106 of the pad 100 is 5 23/32 inches. At its widest, the channels 112 have a width of 0.232 inches. In different embodiments any one or more dimensions of the pad 100 may differ from those of the depicted example pad 100.

Figure 6:
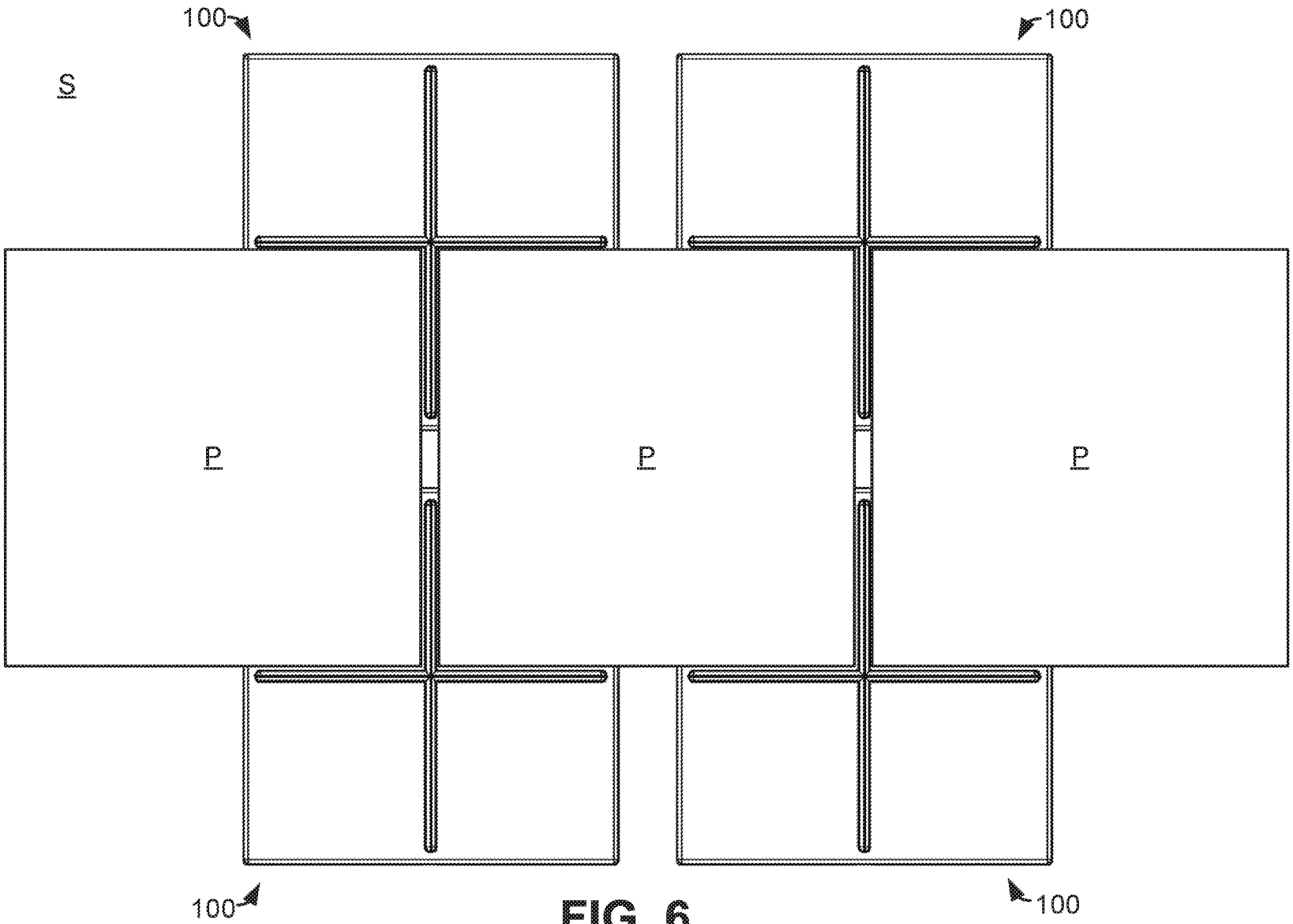
FIG. 6 shows a surface manufactured with pavers laid using multiple instances of the apparatus of FIG. 1.

FIG. 6 shows an example surface being constructed using multiple pads 100. In FIG. 6, four of the pads 100 are used to lay three of the pavers P. The pads 100 are laid on a firm substrate S, such as packed soil or a rooftop. Each of the pavers P is positioned to lay flat against a portion of the top surface of at least one of the pads 100. The leftmost paver P in FIG. 6 is positioned to lay on the bottom left and top left quadrants of the leftmost pads 100; the middle paver P in FIG. 6 is positioned to lay on the bottom right quadrant of the top left pad 100, the bottom left quadrant of the top right pad 100, the top right quadrant of the bottom let pad 100, and the top left quadrant of the bottom right pad 100; and the rightmost paver P in FIG. 6 is positioned to lay on the bottom right and top right quadrants of the rightmost pads 100. The pavers P are pressed horizontally against the paver guides 110, thus helping to ensure consistent spacing between the pavers P. Furthermore, the elastomeric polymer has a relatively high coefficient of friction compared to other potential raw materials, such as hard plastic, thus inhibiting movement of the pavers P while they rest on the pad 100. Furthermore, the elastomeric polymer is inherently flexible and a shock and noise absorbing material; the pad 100 depicted in FIGS. 1 to 5 accordingly has anti-vibration properties and experimentally has been found to withstand a total load exceeding 12,000 pounds, which when the pad 100 measures 6"×6" is equivalent to over 350 psi. The resulting surface manufactured using the pavers P and the pads 100 accordingly is stable, able to absorb shock, comprises equally spaced pavers P, and does not require any adhesive or bonding agent. Additionally, the channels 112 on the underside 106 of the pads 100 may help with drainage in that they may help to channel runoff along the substrate S to a drainage area (not shown). The corners of the surface manufactured using the pavers P may be spaced higher than the rest of the surface to facilitate water runoff.

Although not depicted in FIG. 6, shims may be used to adjust the heights of one or more of the pavers 100 in order to adjust the height of the surface manufactured using the pavers P, as desired. For example, if the substrate S is not level, shims may be used to adjust the height of the pavers P so that the resulting manufactured surface is nonetheless level.

Figure 2:
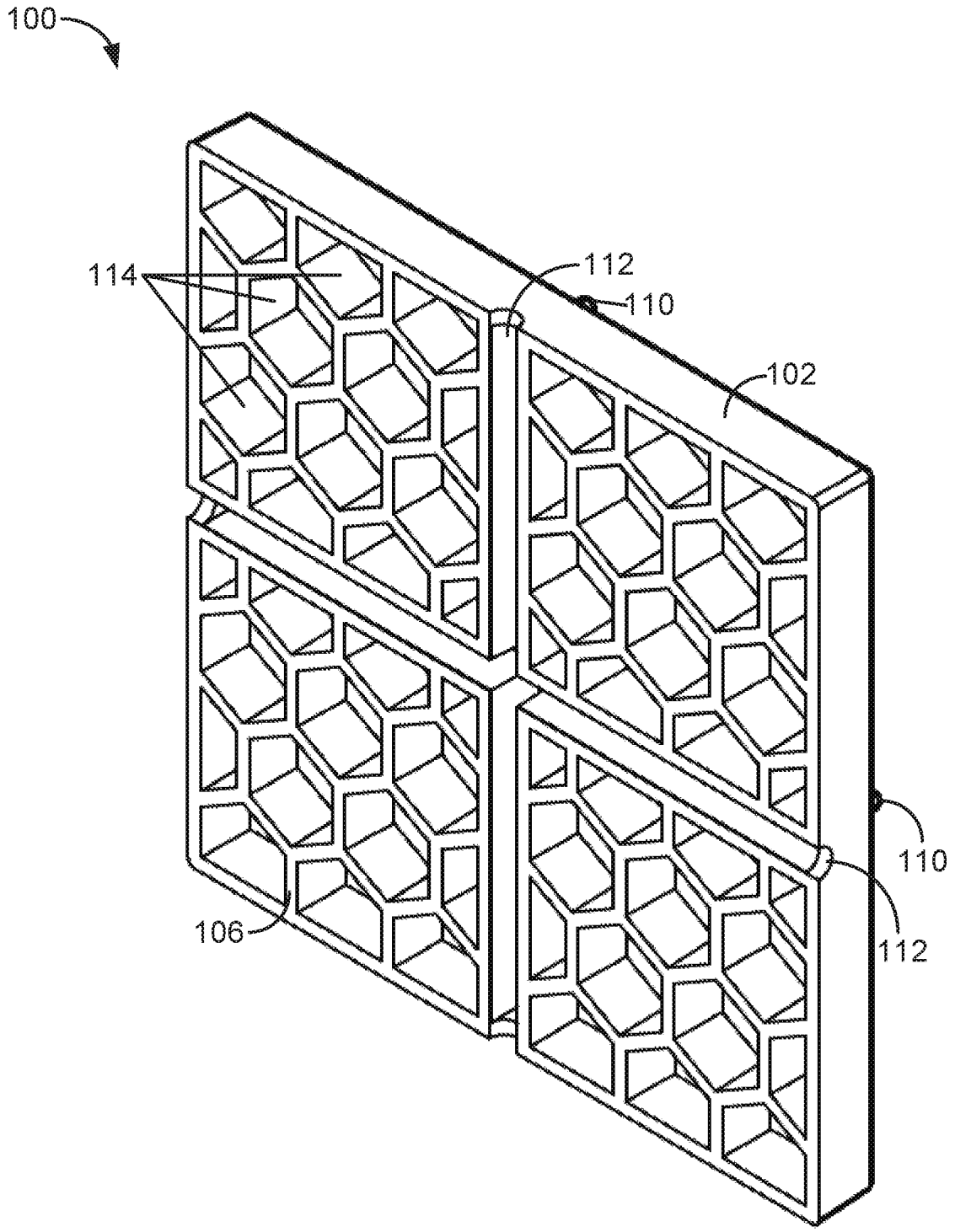
FIG. 2 is a bottom perspective view of the apparatus of FIG. 1.

As depicted, the pad 100 is square and the channels 112 connect all four sides of the pad 100. However, in different embodiments (not depicted) different types of paver guide receivers may be used and, additionally or alternatively, the pad 100 may be a non-square shape. For example, more generally in certain embodiments the pad 100 may be polygonal and may comprise a channel 112 that extends from one side of the pad 100 to another side of the pad 100; in a subset of these embodiments, the channel 112 may extend between two sides of the pad 100 that are not directly adjacent to each other. For example, as evident particularly in FIGS. 2 and 5, the cruciform channels 112 of the depicted pad 100 comprise one channel 112 that extends between a first pair of opposing sides of the pad 100 and a second channel 112 that extends between a second pair of opposing sides of the pad 100; in different embodiments of the pad 100 (not depicted), the pad 100 may comprise only one of the pairs of channels 112 shown in FIGS. 2 and 5. Similarly, the pad 100 in certain embodiments may be rectangular and comprise either a pair of channels 112 extending between opposing sides of the pad 100, similar to what is shown in FIGS. 2 and 5, or comprise only one of the pairs of channels 112.

Figure 7:
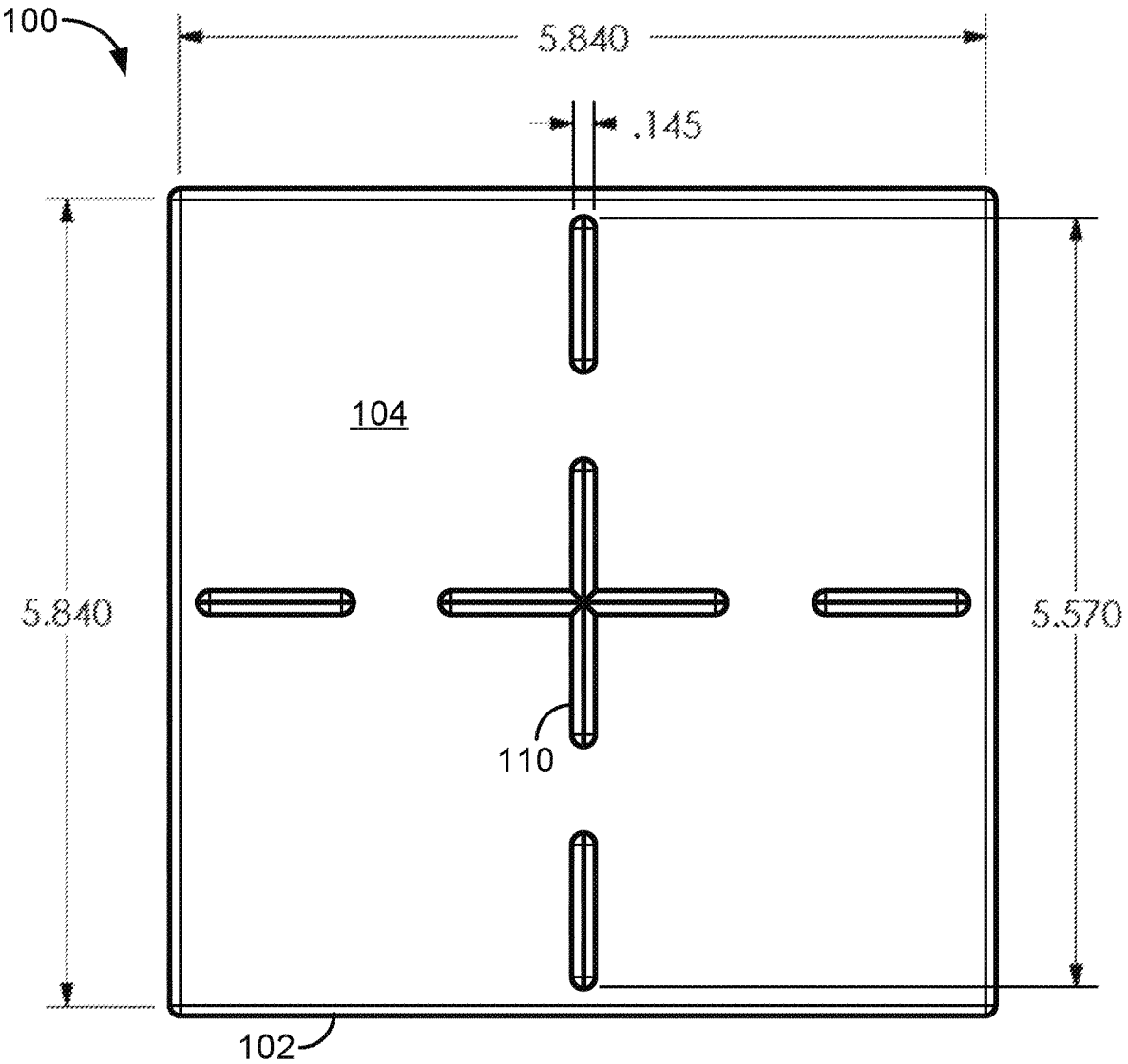
FIG. 7 is a top plan view of an apparatus for laying a paver, according to another example embodiment.

The paver guide 110 shown in the figures has substantially constant height along its length. However, in different embodiments (not depicted), the paver guide 110 may vary in height. For example, in one embodiment the paver guide 110 may be cruciform and centered on the pad 100 and have a maximum height at a center of the body portion 102 and taper to a minimum height at a periphery of the body portion 102. In another different embodiment, for example as depicted in FIG. 7, the paver guide 110 may comprise discrete line segments as opposed to the continuous lines shown in FIGS. 1 to 5; in some embodiments, these discrete line segments may be aligned so as to permit alignment of pavers P in a manner similar to that permitted by the depicted continuous paver guide 110. In various other embodiments (not depicted), the paver guide 110 may be any one or more of shaped differently to accept non-square or non-rectangular pavers, not centered on the pad 100, and differently shaped to allow a single one of the pavers P to cover more or less than the approximately one quarter of the top side 104 of the pad 100 that the paver guide 110 of the pad 100 of FIGS. 1 to 5 allows. For example, in one different embodiment (not depicted) the paver guide 110 of the depicted pad 100 is rotated by 45 degrees so that the paver guide 110 extends across the pad's 100 corners. Additionally or alternatively, the pad 100 may be cut so as to permit only portions of the pad 100 to be used for certain portions of the surface (e.g., corners).

In different embodiments (not depicted), the apparatus may be manufactured differently than as shown in FIGS. 1 to 6. For example, instead of comprising a pad of elastomeric material cast from a mold, the apparatus may be assembled from distinct components that are one or both of fitted and fastened together. Alternatively, the apparatus may be unibody but manufactured differently than as described above, such as by using injection molding, compression molding, or 3D printing.

Directional terms such as "top", "bottom", "upwards", "downwards", "vertically", and "laterally" are used in this disclosure for the purpose of providing relative reference only, and are not intended to suggest any limitations on how any article is to be positioned during use, or to be mounted in an assembly or relative to an environment.

Additionally, the term "couple" and variants of it such as "coupled", "couples", and "coupling" as used in this disclosure are intended to include indirect and direct connections unless otherwise indicated. For example, if a first article is coupled to a second article, that coupling may be through a direct connection or through an indirect connection via another article.

Furthermore, the singular forms "a", "an", and "the" as used in this disclosure are intended to include the plural forms as well, unless the context clearly indicates otherwise.

It is contemplated that any part of any aspect or embodiment discussed in this specification can be implemented or combined with any part of any other aspect or embodiment discussed in this specification.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. An apparatus for laying a paver, the apparatus comprising:
(a) a body portion having a top side and an underside, the underside comprising a hollow portion; and
(b) a raised paver guide located on the top side, the raised paver guide positioned to receive the paver when the paver is against the top side,
wherein the raised paver guide is cruciform and extends through a center of the top side, and wherein the apparatus is shaped to permit the paver to extend beyond an edge of the top side of the body portion when the paver is pressed only against one or more sides of the raised paver guide.

2. The apparatus of claim 1 wherein the hollow portion comprises a paver guide receiver shaped to receive the raised paver guide such that a first instance of the apparatus is stackable on a second instance of the apparatus by inserting the raised paver guide of the second instance of the apparatus into the paver guide receiver of the first instance of the apparatus.

3. The apparatus of claim 1 wherein the body portion is shaped as a closed curve.

4. The apparatus of claim 1 wherein the body portion is shaped as a polygon, and wherein the paver guide receiver comprises a channel that extends from one side of the polygon to another side of the polygon.

5. The apparatus of claim 4 wherein the polygon is a square or rectangle, and wherein the channel extends from one side of the square or rectangle to an opposing side of the square or rectangle.

6. The apparatus of claim 5 wherein the paver guide receiver is cruciform, defines a first cross shape, wherein a center of the first cross shape is centered on the underside of the body portion, wherein the raised paver guide defines a second cross shape, and wherein a center of the second cross shape is centered on the top side of the body portion.

7. The apparatus of claim 6 wherein the paver guide tapers from a maximum height at a center of the body portion to a minimum height at a periphery of the body portion.

8. The apparatus of claim 6 wherein the paver guide comprises continuous lines.

9. The apparatus of claim 6 wherein the paver guide comprises discrete line segments, wherein at least some of the line segments are aligned with each other.

10. The apparatus of claim 1 wherein the underside comprises support columns, each of which has a hollow interior and extends from the top side to the underside, and wherein the hollow portion comprises the hollow interior of each of the support columns.

11. The apparatus of claim 10 wherein each of the support columns has a hexagonal footprint.

12. The apparatus of claim 10 wherein each of the support columns has a circular footprint.

13. The apparatus of claim 1 wherein the body portion and raised paver guide are manufactured using an elastomeric polymer.

14. An apparatus for laying a paver, the apparatus comprising:
(a) a square body portion having a top side and an underside;
(b) a raised, cruciform paver guide located on the top side, the raised paver guide extending through a center of the top side of the body portion, centered on the top side, and positioned to receive the paver when the paver is against the top side, and
wherein the underside comprises:
(c) a paver guide receiver centered on the underside and shaped to receive the raised paver guide, wherein the paver guide receiver comprises a first channel extending between one pair of opposing sides of the body portion and a second channel extending between another pair of opposing sides of the body portion, wherein the first and second channels intersect at a center of the underside; and (d) hexagonal support columns, each of which has a hollow interior and extends from the top side to the underside, wherein the apparatus is shaped to permit the paver to extend beyond an edge of the top side of the body portion when the paver is pressed only against one or more sides of the raised paver guide.

15. A surface, comprising:

(a) multiple apparatuses for laying a paver, wherein each of the apparatuses is laid on a substrate and comprises: a body portion having a top side and an underside, the underside comprising a hollow portion; and (ii) a raised paver guide located on the top side, the raised paver guide positioned to receive the paver when the paver is against the top side, wherein the raised paver guide is cruciform and extends through a center of the top side of the body portion; and (b) pavers laid on the top side of each the apparatuses, wherein each of the pavers is received by at least one of the raised paver guides, wherein the apparatus is shaped to permit the paver to extend beyond an edge of the top side of the body portion when the paver is pressed only against one or more sides of the raised paver guide.

16. The surface of claim 15, wherein each paver contacts at least one side of at least one raised paver guide without touching a top of the at least one raised paver guide.

* * * * *